US005722918A

United States Patent [19]

Lee

[11] Patent Number: 5,722,918

[45] Date of Patent: Mar. 3, 1998

[54] JOGGER EXERCISE WITH DIRECTION ADJUSTABLE SADDLE AND HANDLEBAR

[76] Inventor: Kuo-Ron Lee, No. 61, Mai Jou II Rd., Yi Lan City, Taiwan

[21] Appl. No.: 744,932

[22] Filed: Nov. 6, 1996

[51] Int. Cl.[6] ..... A63B 69/06

[52] U.S. Cl. ..... 482/72; 482/51; 482/119

[58] Field of Search ..... 482/72, 96, 73, 482/95, 97, 142, 133, 57

[56] References Cited

U.S. PATENT DOCUMENTS

| | | | |
|---|---|---|---|
| 5,580,340 | 12/1996 | Yu | 482/96 |
| 5,582,562 | 12/1996 | Wang et al. | 482/96 |
| 5,584,785 | 12/1996 | Wu | 482/96 |
| 5,658,227 | 8/1997 | Stearns | 482/96 |

*Primary Examiner*—Jerome Donnelly
*Attorney, Agent, or Firm*—Varndell Legal Group

[57] ABSTRACT

A jogger exerciser in which a saddle is connected to an arm member on support frames by a locating plate and a coupling sleeve and fixed in position by a latch. The locating plate is fastened to the bottom of the saddle and can be rotated between two positions. The locating plate has two locating holes at opposite sides thereof, and the latch is inserted into one of the two locating holes to fix the saddle in one of the two positions. A substantially arched foot support is fastened to a rear end of the arm member for the resting of the user's feet when the saddle is set in a backward position. A handlebar stem is mounted in a sleeve member and rotatably securable in a forward facing position or a backward facing position by the use of a lock pin mounted in a radial hole in the sleeve member and forced into engagement with one locating hole at one side of the handlebar stem.

3 Claims, 12 Drawing Sheets

JOGGER EXERCISE WITH DIRECTION ADJUSTABLE SADDLE AND HANDLEBAR

BACKGROUND AND SUMMARY OF THE INVENTION

The present invention relates to jogger exercisers, and more particularly, to such a jogger exerciser in which the handlebar and the saddle can be respectively turned between a forward facing position and a backward facing position, and then fixed at the desired position.

FIGS. 1 and 2 show a jogger exerciser according to the U.S. Ser. No. 08/620,166 filed by the same inventor. This structure of jogger exerciser comprises two pivotally connected supporting frames, a seat assembly supported on the top of the supported frames, and a handlebar assembly connected to the front side of the supporting frames. The seat assembly is connected to the handlebar assembly by means of a link, so that pulling or pushing of the handlebar by a user sitting on the seat causes the seat assembly to move forward and upward or backward and downward, respectively, just like riding a horse. While this structure of jogger exerciser is useful, it has limited function. The structure of this jogger exerciser is limited in that the hand grip cannot be turned relative to the handlebar stem. Thus, it can only be operated in one mode like riding a horse, where it can be operated to effectively exercise the muscles of the abdomen and the waist.

The present invention provides a jogger exerciser that overcomes the drawbacks of the aforesaid jogger exerciser.

According to one aspect of the present invention, the jogger exerciser comprises a first support frame including two upright extending parallel rod members and a transverse lower portion, a second support frame having a transverse lower portion and two upwardly extending vertical portions, a handlebar assembly having a sleeve member and a handlebar stem mounted in said sleeve, a saddle assembly having an arm member pivoted between the two upwardly extending parallel rod members of the first support frame and connected to the handlebar assembly and a saddle mounted on the arm member, and two unions or link means for interconnecting the first support frame, the second support frame, and the sleeve member of the handlebar assembly together. The saddle is connected to the arm member by a locating plate and a coupling sleeve and removably fixed in position by latch means. The locating plate is fastened to the saddle at the bottom thereof and can be mounted on the coupling sleeve in one of two positions. The locating plate has two locating holes at two opposite sides thereof, and the latch means can be inserted into one of the two locating holes to fix the saddle in one of the two positions. A substantially arched foot support is fastened to the rear end of the arm member of the saddle assembly at an end supporting the saddle for the resting of the user's feet. The handlebar stem of the handlebar assembly has a rounded lower end inserted into a socket at a top end of the sleeve member of the handlebar assembly and rotatable between a forward facing position and a backward facing position, and two rows of longitudinally spaced locating holes at the rounded lower end at two opposite sides. The sleeve member of the handlebar assembly has a socket at a top end thereof which receives the rounded lower end of the handlebar stem. A lock pin is mounted in a radial hole of the sleeve member, and can be inserted into one of the two rows of longitudinally spaced locating holes of the lower end of the handlebar stem to fix the handlebar stem in one of the forward facing and backward facing positions.

According to another aspect of the present invention, the handlebar assembly further comprises a substantially U-shaped handlebar pivoted to one end of the handlebar stem at a distance from the sleeve member of the handlebar assembly, and two hand grips fastened to two opposite ends of the handlebar.

DETAILED DESCRIPTION OF THE PREFERRED EMBODIMENT

Figure 1:
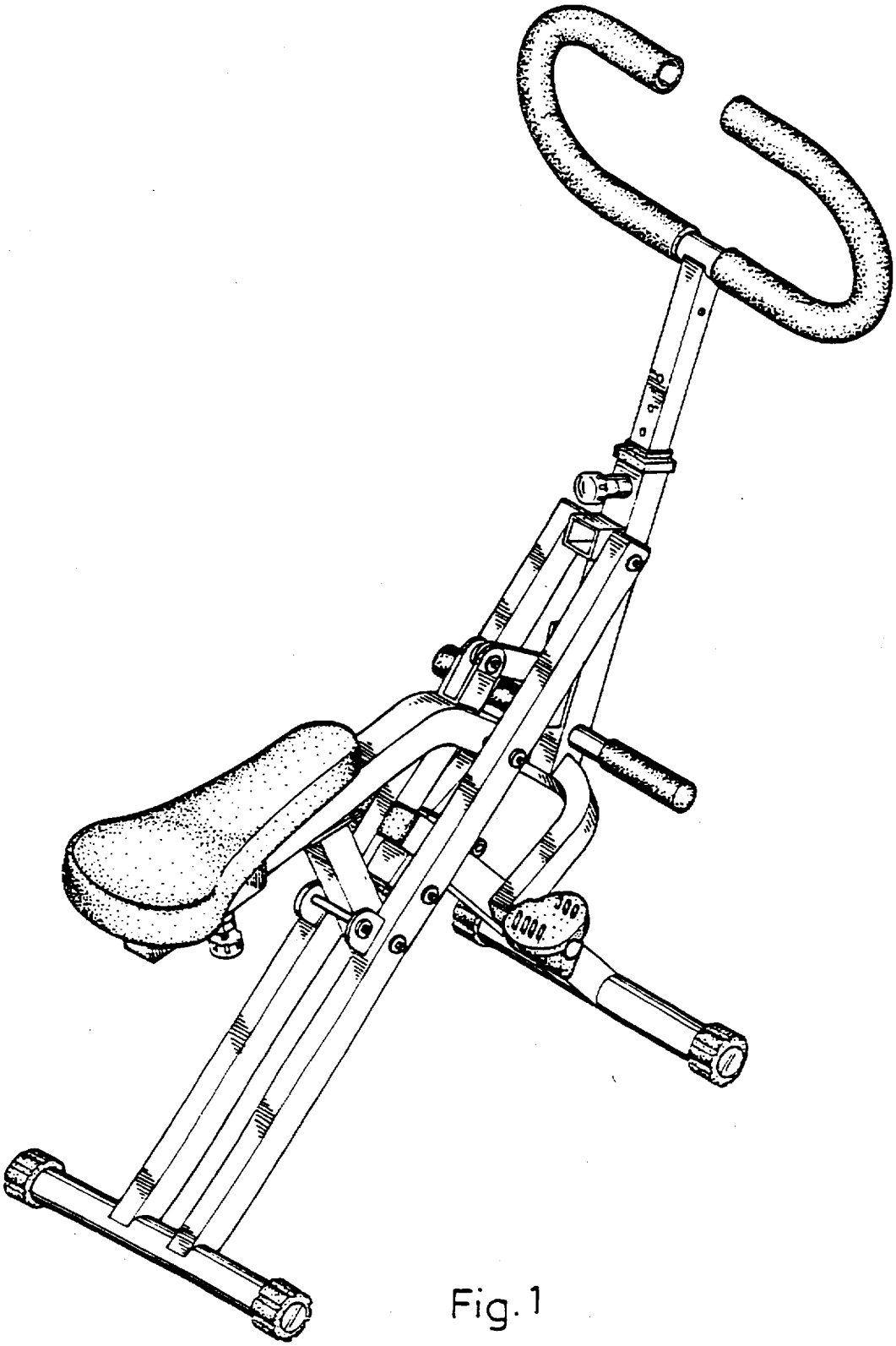
FIG. 1 is a perspective elevational view of a jogger exerciser according to U.S. patent application No. 08/620,166.
Figure 2:
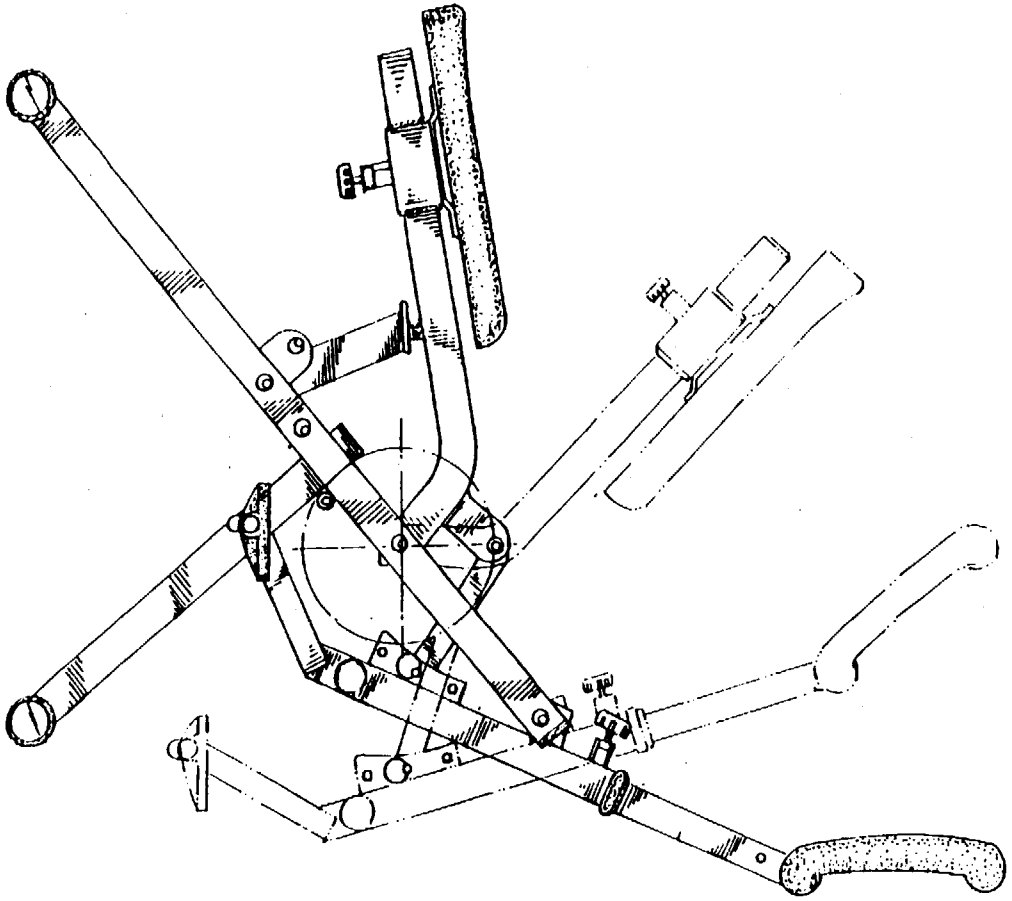
FIG. 2 shows the operation of the jogger exerciser of FIG. 1.
Figure 3:
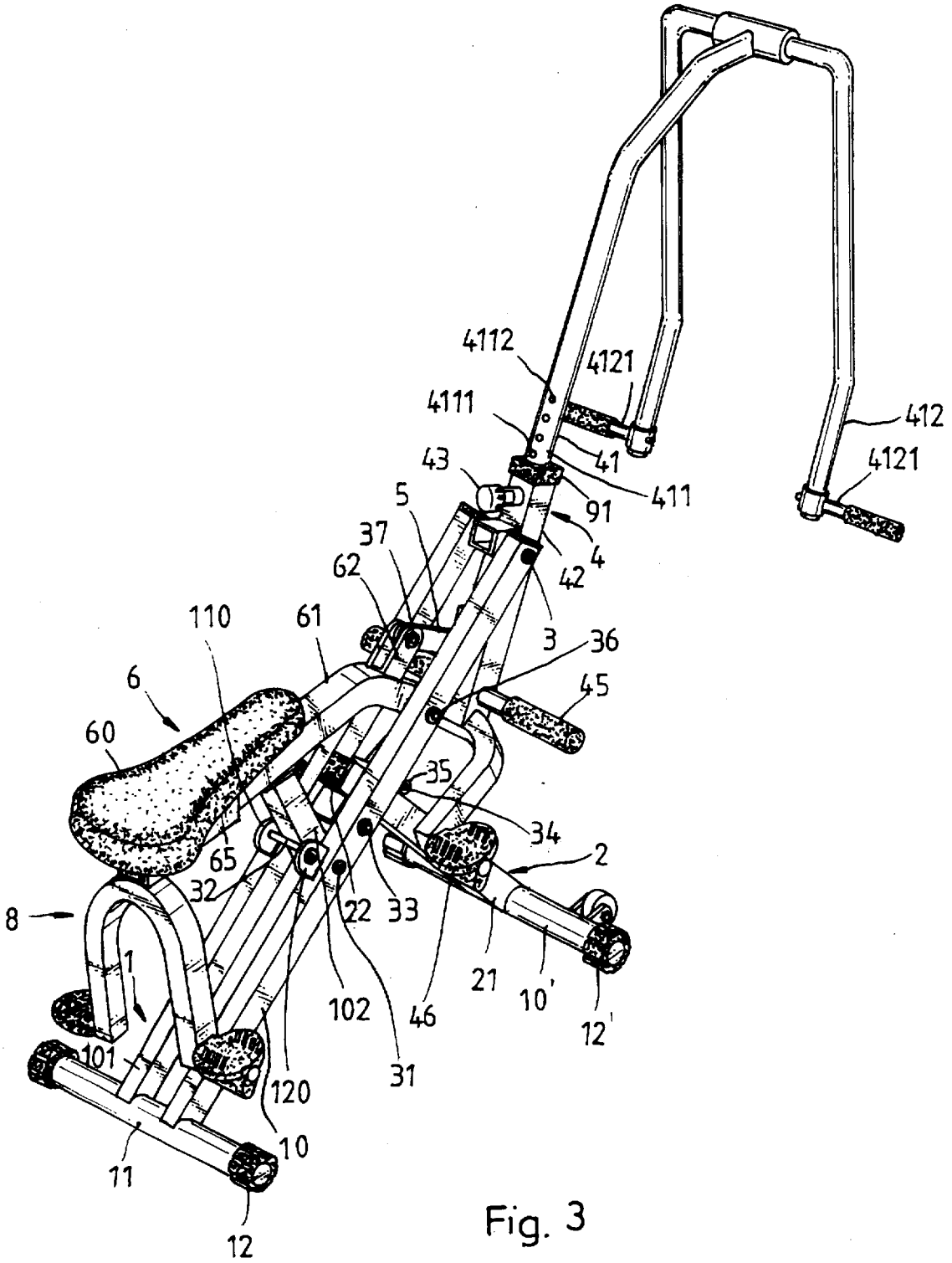
FIG. 3 is a perspective elevational view of a jogger exerciser according to the present invention.
Figure 4:
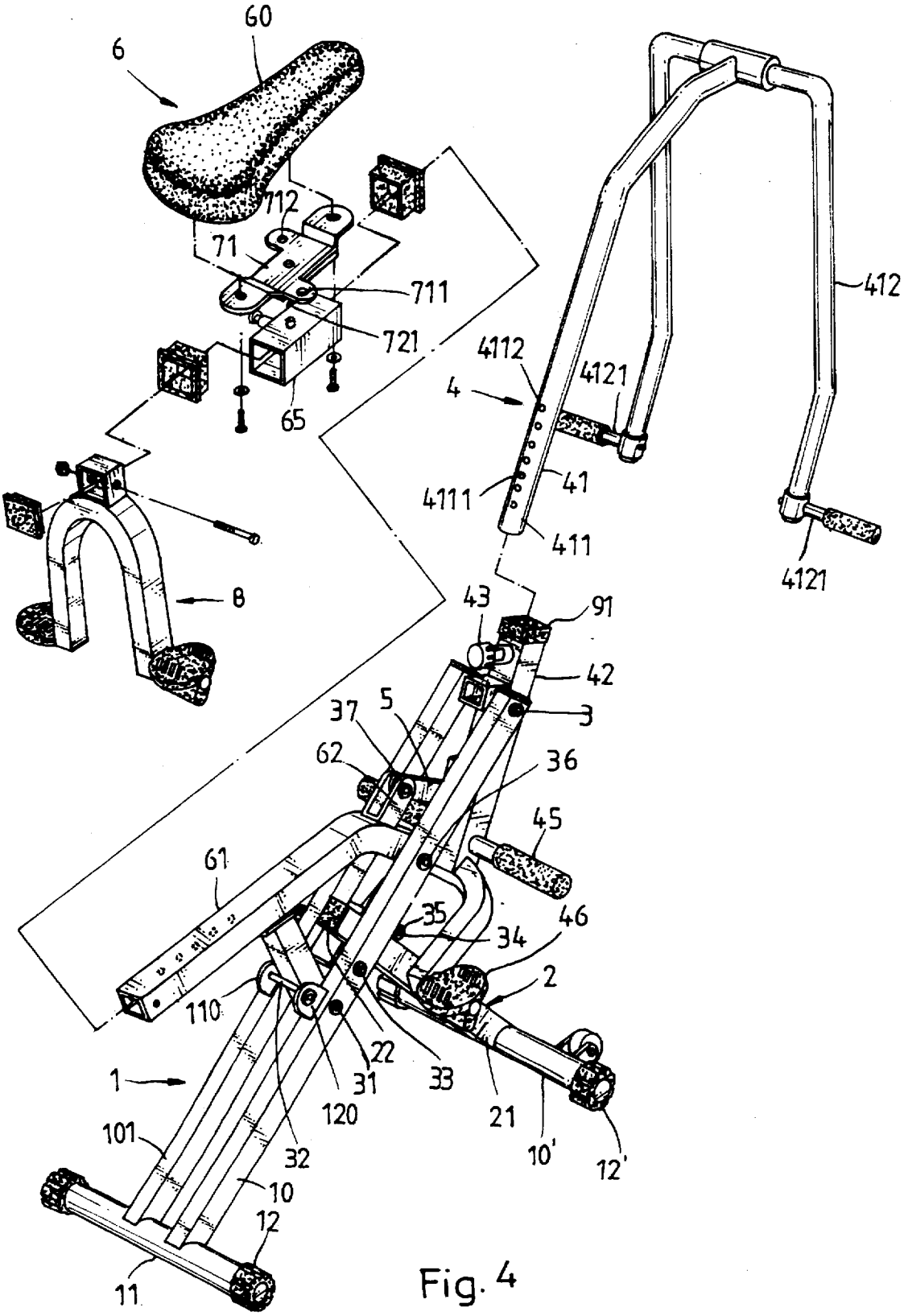
FIG. 4 is an exploded view of the jogger exerciser shown in FIG. 3.
Figure 5:
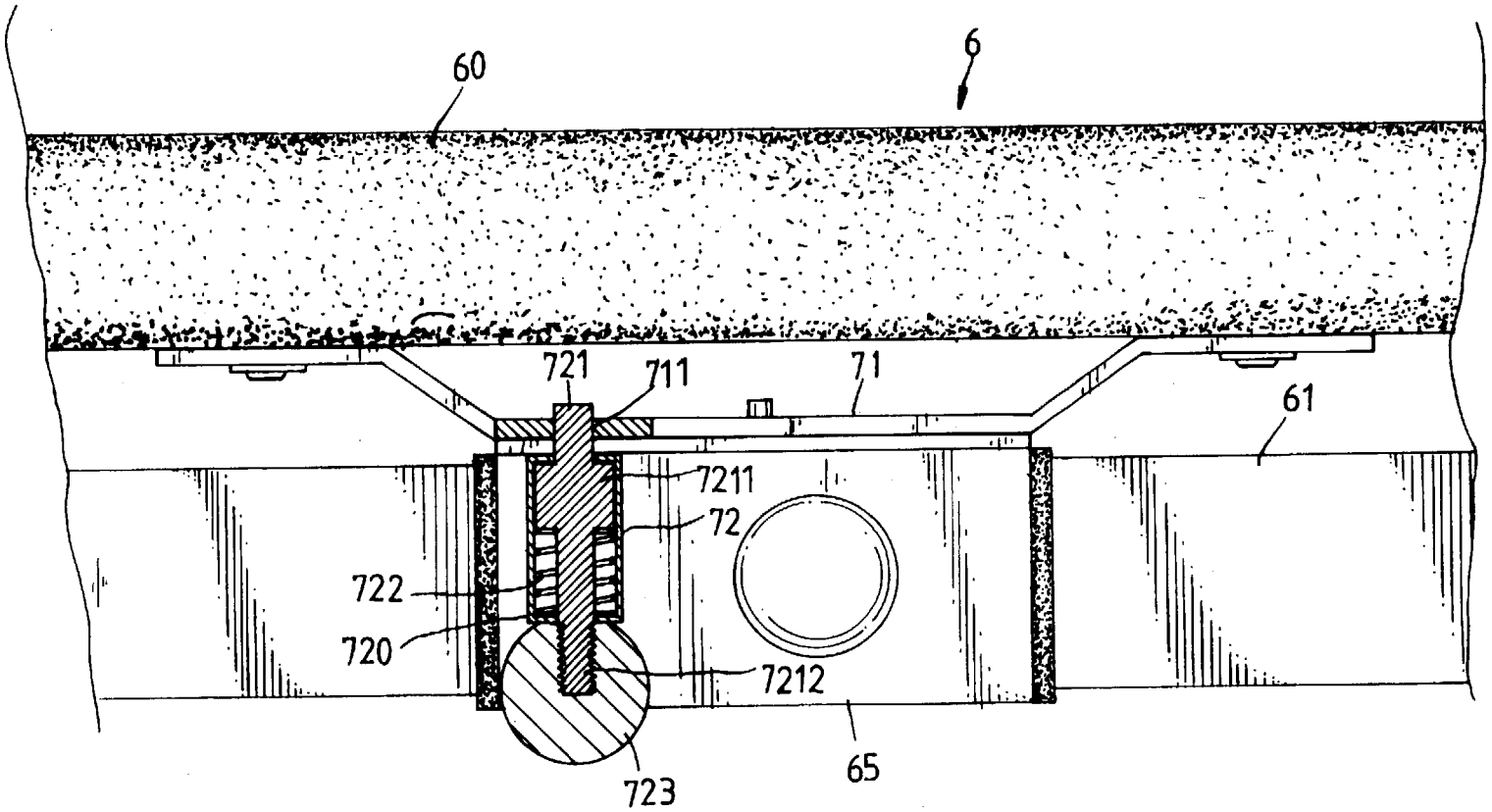
FIG. 5 is an enlarged view of a part of the present invention, showing the structure of the latch means.
Figure 6:
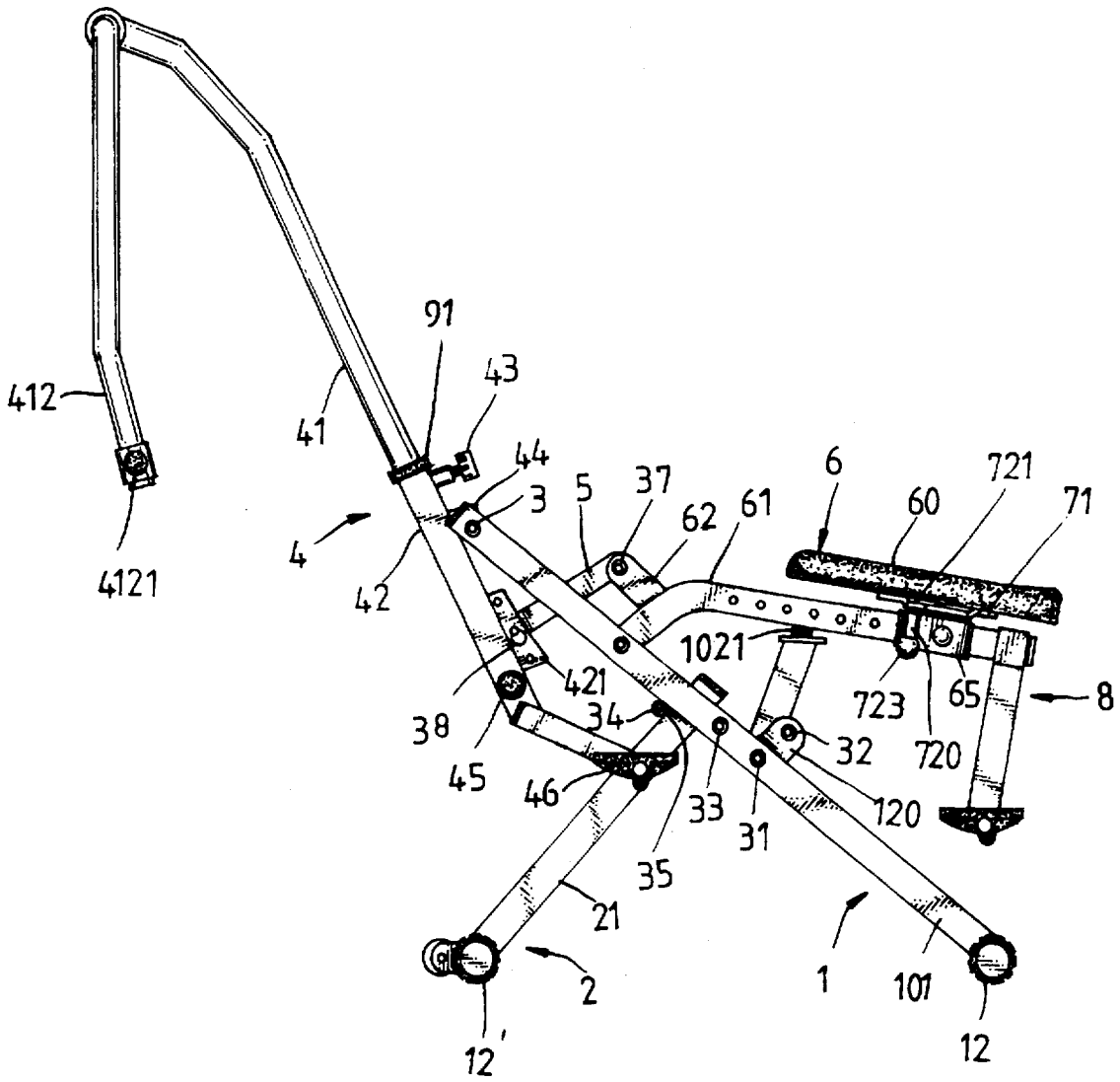
FIG. 6 is a side view of the jogger exerciser according to the present invention.
Figure 7:
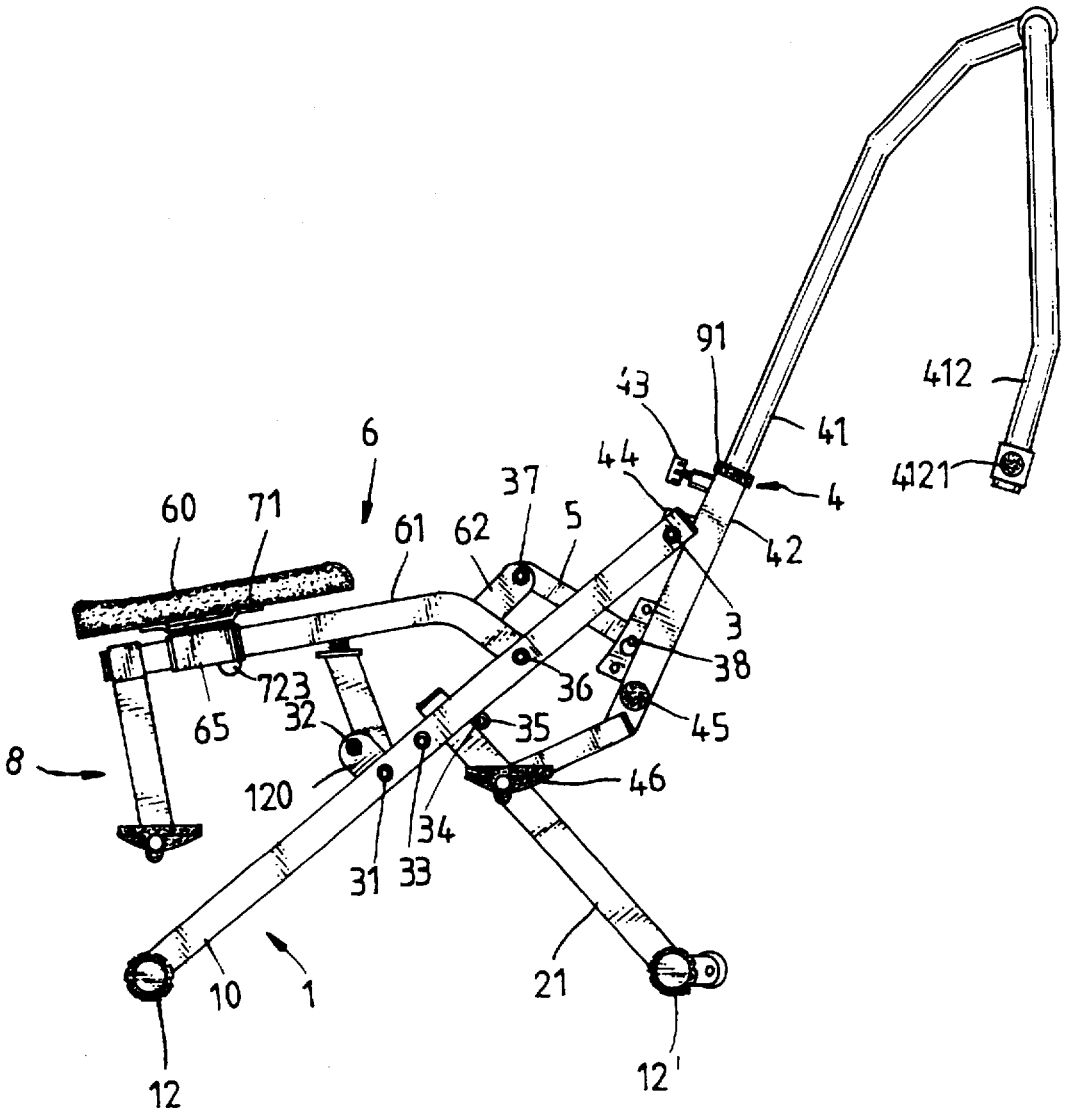
FIG. 7 is another side view of the jogger exerciser according to the present invention.
Figure 8:
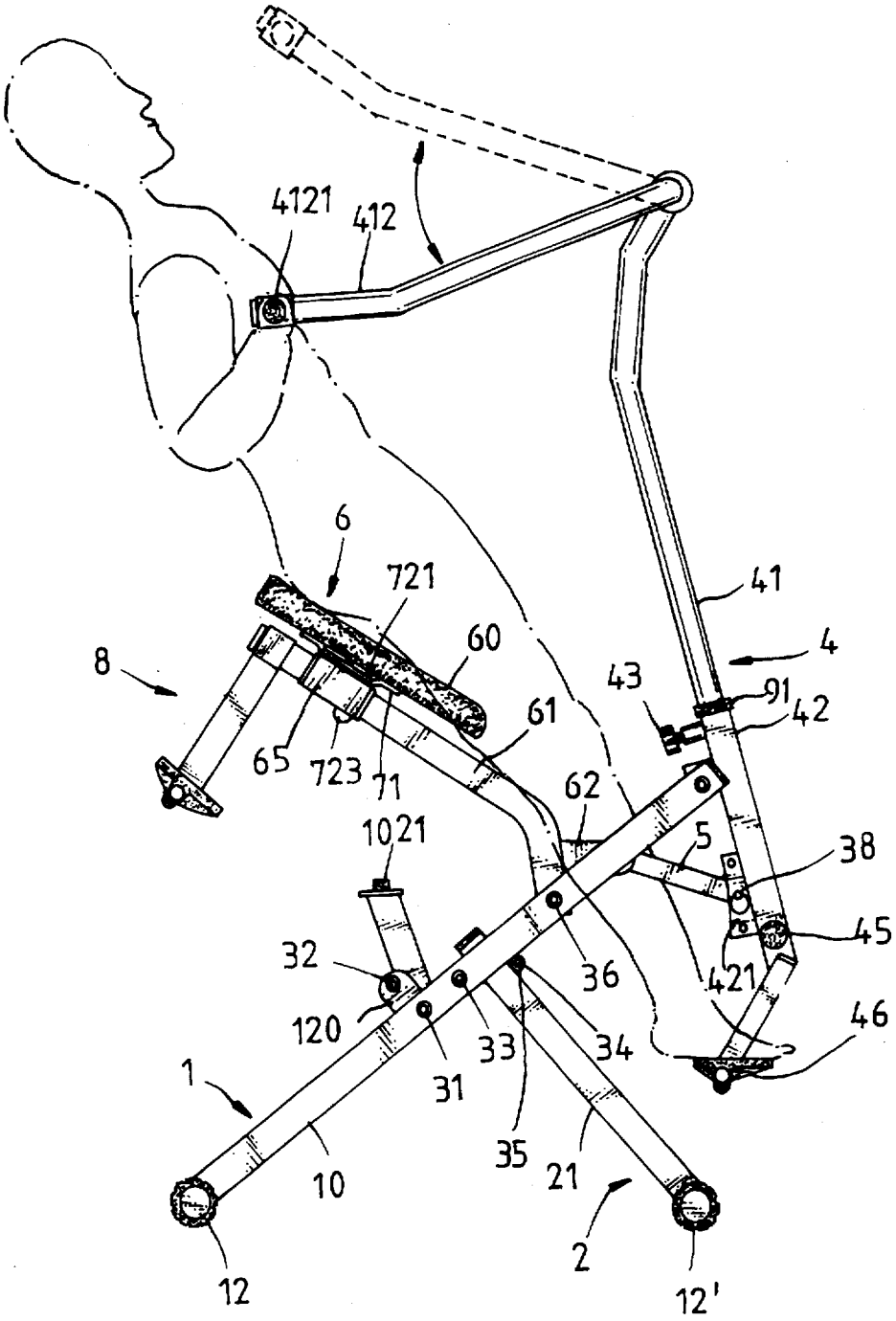
FIG. 8 is an applied view of the present invention, showing the jogger exerciser set in one mode and operated.

The follow descriptions reference FIGS. 3 to 12. The present invention comprises an upper support frame 1, a lower support frame 2, a handlebar assembly 4, and a seat assembly 6.

The upper support frame 1 comprises two parallel rod members 10, 101. The rod members 10, 101 are pivotally connected at their top ends to the handlebar assembly 4 near a middle neck portion thereof by means of a first shaft 3 which serves as a fulcrum, so that the handlebar assembly 4 can be pivotally moved about the shaft 3 relative to the seat assembly 6. The rod members 10, 101 are fixedly connected at their lower ends to a transversely extending bar 11 that is positioned on the floor to support the rod members 10, 101. The bar 11 has an anti-slip means 12 provided on each end thereof. A pair of lugs 110, 120 are provided on the rod members 10, 101, respectively, near a top middle portion thereof for a first pin 32 to extend therebetween. A pillar 102 is connected between the rod members 10, 101 by a second shaft 31, such that when the jogger exerciser is in an extended state, the pillar 102 just projects upward from and between the rod members 10, 101 to stop in front of the pin 32 extending between the lugs 110, 120 and abut the pin 32. A pad 1021 is attached to a top end of the pillar 102 to receive and support the seat assembly 6. A third shaft 33 extends between the rod members 10, 101 at a position adequately in front of the second shaft 31 for the lower support frame 2 to press thereagainst. A cylindrical member 35 with a second pin 34 axially inserted therein is fixed to the bottom side of the rod members 10, 101 slightly above or in front of the shaft 33. When the upper and the lower support frames 1, 2 extend relative to each other, the lower support frame 2 rests against the cylindrical member 35 without further extending forward, so that the lower support frame 2 is firmly held between the third shaft 33 and the cylindrical member 35 without shifting. A fourth shaft 36 extends between the rod members 10, 101 at a position higher than the cylindrical member 35 and the pin 34 to pivotally connect the seat assembly 6 thereto, which serves as a fulcrum for the seat assembly 6 to turn relative to the upper support frame 1.

The lower support frame 2 comprises an upward extended pillar portion 21 extending between the rod members 10, 101 as well as between the shaft 33 and the cylindrical member 35. A transversely extended rod 10' is connected to a lower end of the pillar portion 21. Anti-slip means 12' are attached to two ends of the rod 10' of the lower support frame 2 for holding the lower support frame in position on the floor. The pillar portion 21 has a laterally projected part 22 at a top end thereof so that the part 22 is stopped by and supported on the shaft 33 when the lower support frame 2 is extended relative to the upper support frame 1, thereby serving as a fulcrum and together with the cylindrical member 35 enabling the lower support frame 2 remain in position without shifting after it is extended.

The seat assembly 6 comprises a top saddle 60 and an arm member 61 having one rear end connected to a bottom side of the top saddle 60 and a downward bent end pivotally connected to and between the upper support frame 1 at a higher position thereof by the fourth shaft 36. The bent front end of the arm member 61 has two lugs 62 projected from a top surface thereof, such that a link 5 is connected to the two lugs 62 by a fifth shaft 37 extending therebetween. A lower end of the link 5 is connected to the handlebar assembly 4, so that the seat assembly 6 can move along with the shifted handlebar assembly 4.

The handlebar assembly 4 comprises an inner stem 41 and an outer stem 42. The inner stem 41 can be moved in and out of the outer stem 42, and can be fixed relative to the outer stem 42 at the desired extended length with a locating bolt or lock pin 43 provided near a top end of the outer stem 42. A laterally projected part 44 projects from the top of the outer stem 42 into and between the top ends of the rod members 10, 101 and is pivotally connected thereto by means of the first shaft 3. Two connecting plates 421 are provided on the outer stem 42 at a position lower than the projected part 44, such that the link 5 is pivotally connected at its lower end to and between the two connecting plates 421 by means of a third pin 38. By this structure, the backward or forward movement of the stems 41, 42 actuated by the user shall cause the seat assembly 6 to shift forward or backward at the same time via the link 5 connected between the two assemblies 4 and 6. A pair of footrests 45 and a pair of pedals 46 are provided near and at a lower end of the outer stem 42, respectively, forming two angularly different positions for resting the user's feet. When in use, the user is seated on the top saddle 60 with his or her feet positioned on the footrests 45 or the pedals 46 and hands gripping the handlebar assembly 4. When the handlebar assembly 4 is pulled back toward the user, the seat assembly 6 is brought to turn upward about the fifth shaft 37 relative to the upper support frame 1, just as riding a horse.

Referring to Figures from 4 and 5 again, the top saddle 60 has a locating plate 71 fixedly secured to the bottom side thereof and revolvably mounted on a coupling sleeve 65. The coupling sleeve 65 is mounted around the arm member 61 to hold the top saddle in place. The locating plate 71 has two locating holes 711, 712 obliquely disposed at two opposite sides. A latch means 72 is provided for inserting into the locating hole 711 or 712 to stop the locating plate 71 and the top saddle 60 from rotary motion relative to the coupling sleeve 65 and the arm member 61. A substantially arched foot support 8 is fastened to the rear end of the arm member 61 of the saddle assembly 6 at the bottom for the resting of the feet when the user sits on the top saddle 60 in the reversed direction.

The outer stem 42 of the handlebar assembly 4 has a socket 91 mounted thereon at the top. The inner stem 41 has a rounded lower end 411 inserted into and turned in the socket 91, and two rows of longitudinally spaced locating holes 4111, 4112 (see also FIG. 11) at the rounded lower end 411 at two opposite sides. A lock pin 43 is mounted in a hole (not shown) in the outer stem 42, and inserted into one of the locating holes 4111 or 4112 to fix the inner stem 41 in the outer stem 42 at the desired elevation and direction.

Figure 9:
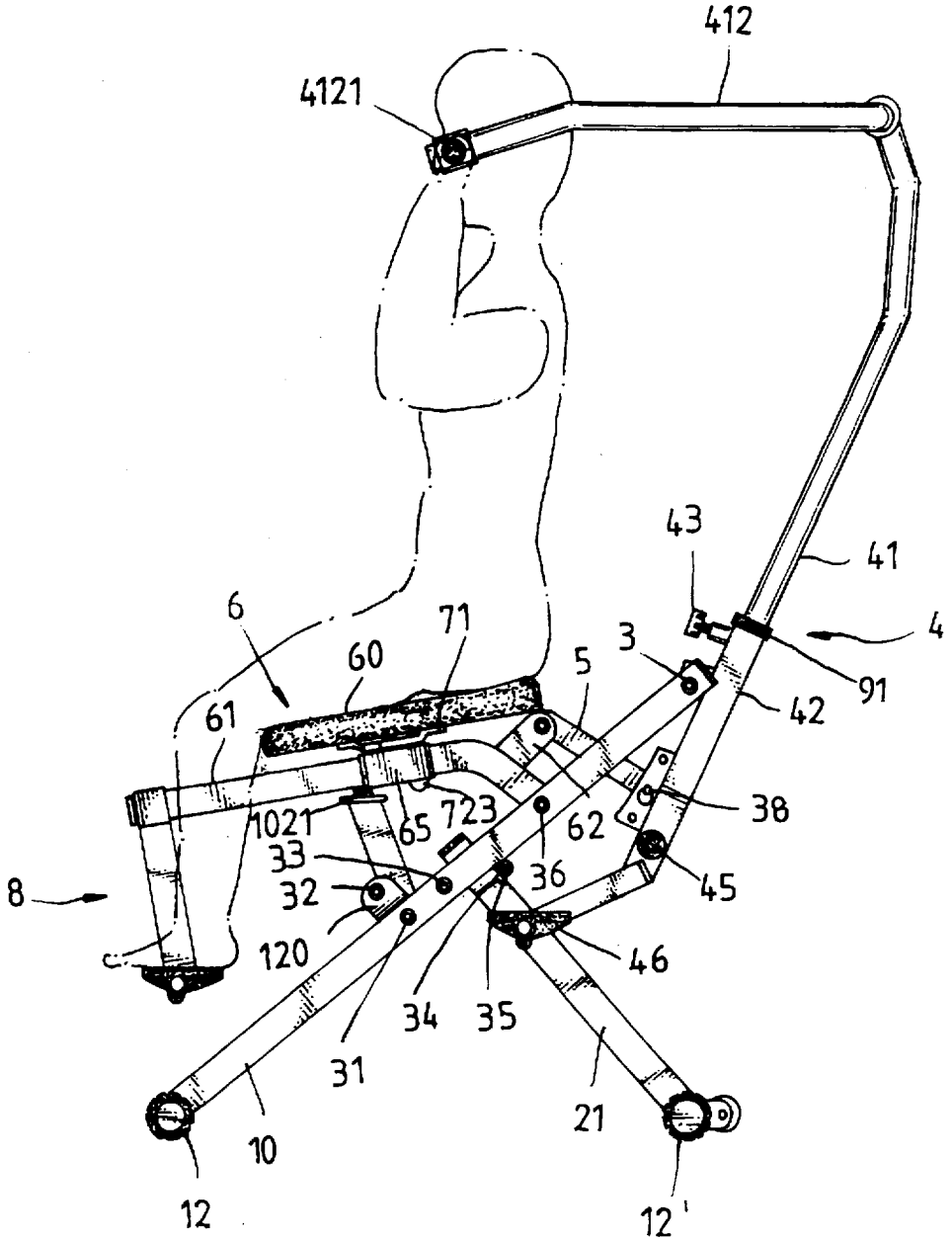
FIG. 9 shows the top saddle and the handlebar assembly respectively set in the backward position according to the present invention.
Figure 10:
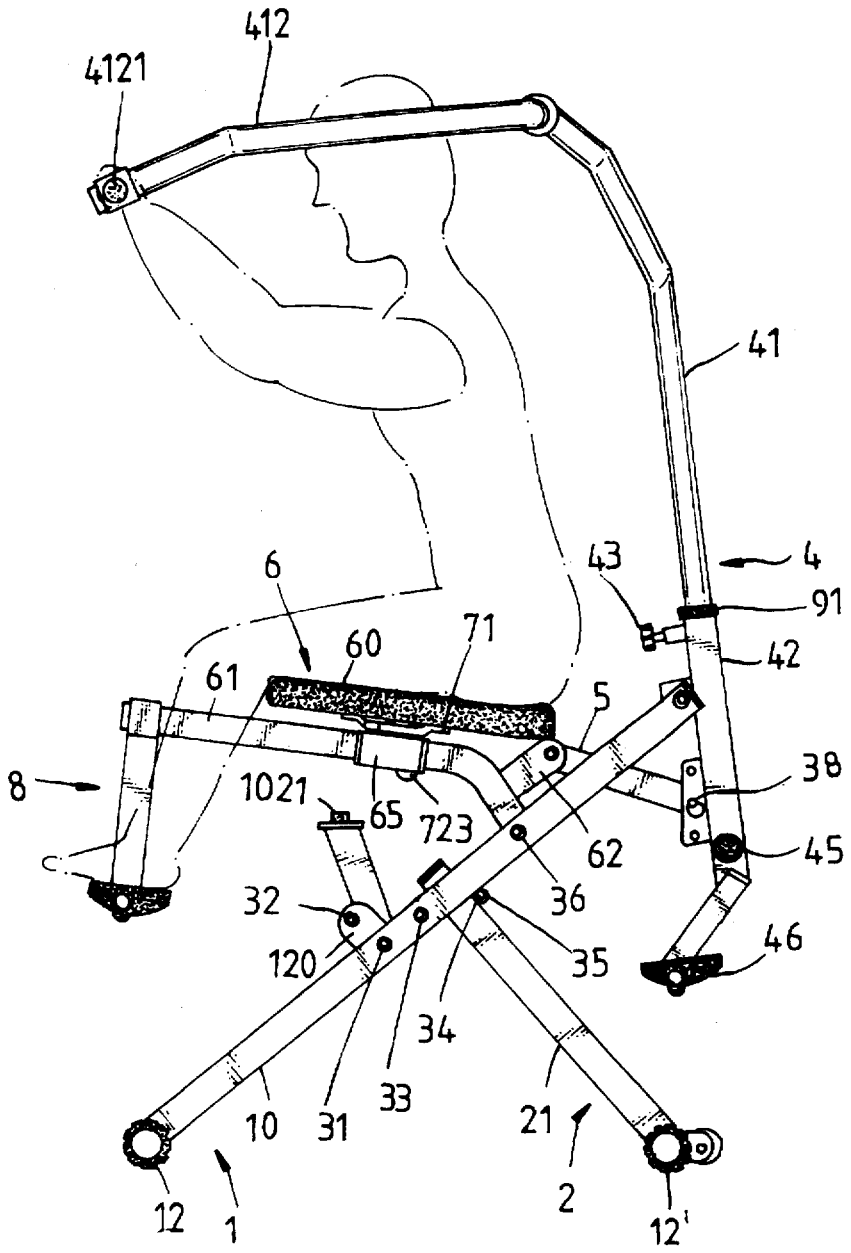
FIG. 10 shows the top saddle and the handlebar assembly respectively set in the backward position and operated according to the present invention.
Figure 11:
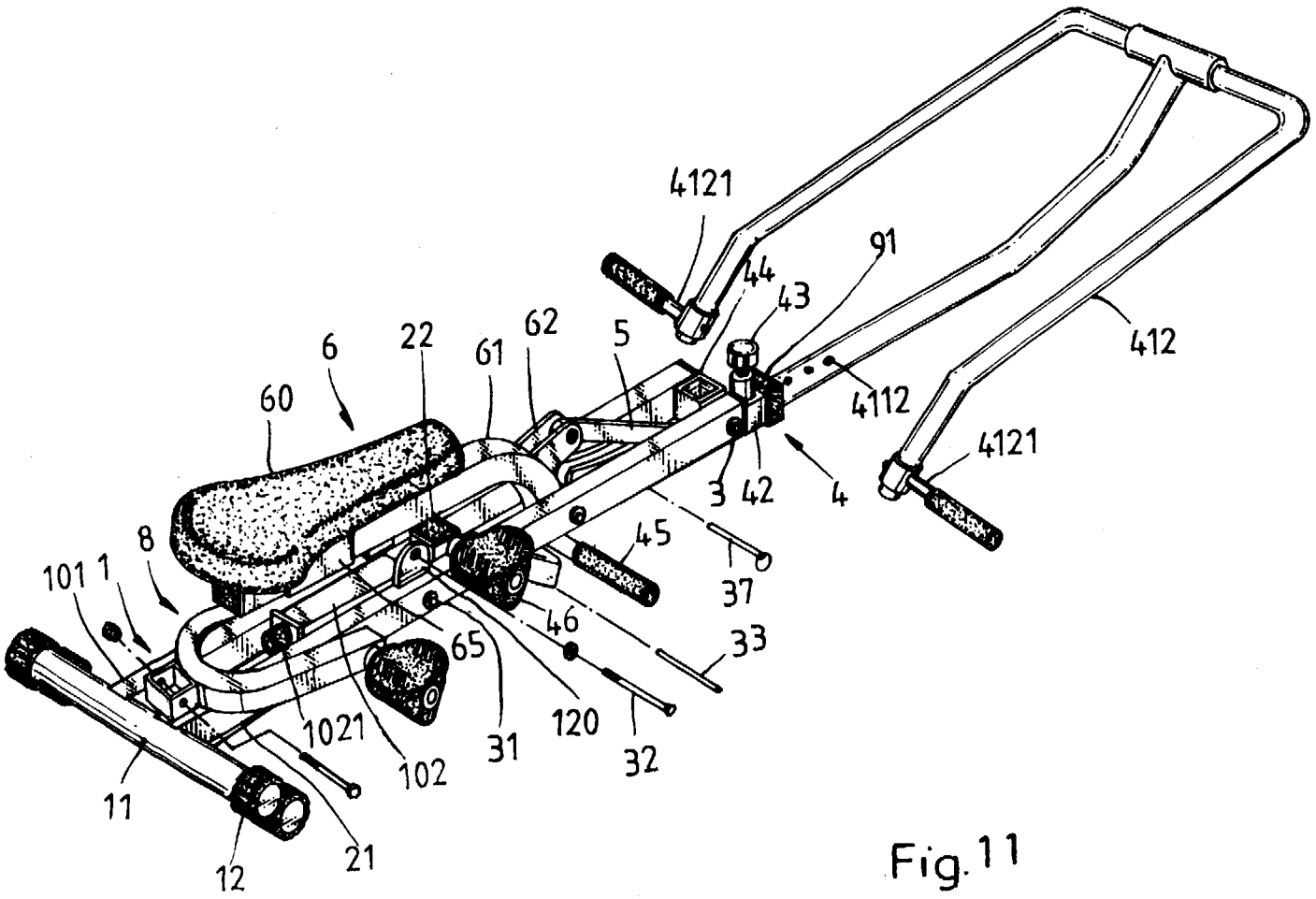
FIG. 11 shows the jogger exerciser collapsed according to the present invention.
Figure 12:
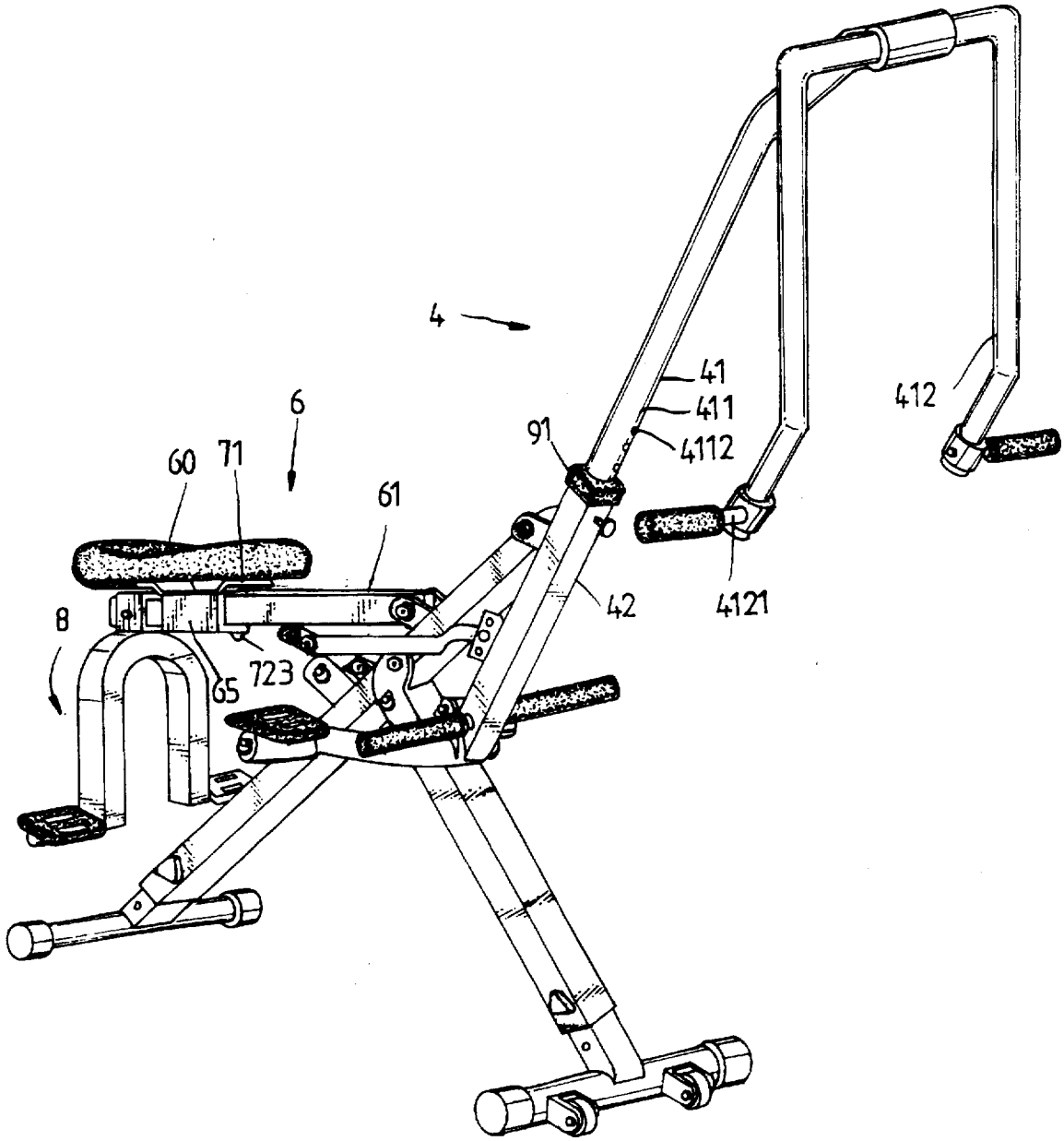
FIG. 12 is another elevational view of the jogger exerciser according to the present invention.

Referring to FIGS. 5 and 6 again, when the latch means 72 is disconnected from the locating hole 711 or 712 of the locating plate 71, the top saddle 60 can be turned relative to the coupling socket 65, and adjusted between two opposite positions, namely, the forward facing position and the backward facing position; when the lock pin 43 is disconnected from the inner stem 41, the inner stem 41 can then be turned in the outer stem 42 to adjust the position of the handlebar assembly 4 between the forward facing position (see FIGS. 6, 7 and 8), and the backward facing position (see FIGS. 9 and 10). When the top saddle 60 of the seat assembly 6 and the inner stem 41 of the handlebar assembly 4 are respectively turned to the forward facing position, the user can operate the jogger exerciser like riding a horse (see FIG. 8). When the top saddle 60 of the seat assembly 6 and the inner stem 41 of the handlebar assembly 4 are respectively turned to the backward facing position, the user can then sit on the top saddle 60 with the legs rested on the arched foot support 8 and the hand gripping two hand grips 4121 at two opposite ends of a substantially U-shaped handlebar 4 12, which is pivoted with its middle portion to one end of the inner stem 41 a distance from the outer stem 42. The pivoting of the handlebar 412 relative to the stem 42 permits pulling the handlebar 412 downward or otherwise rotating the handlebar 412 relative to the stem 42, so as to exercise the muscles of the hands, legs, abdomen, etc.

Referring to FIGS. 4 and 5 again, the aforesaid latch means 72 is comprised of a barrel 720, a latch 721, a spring 722, and a knob 723. The barrel 720 is fastened to the coupling socket 65 at one side thereof and has a top hole and a bottom hole (not shown). The latch 721 is mounted in the barrel 720 and movably extends out of the top hole of the barrel 720 for inserting into the locating hole 711 or 712 to fix the top saddle 60 in the forward facing position or backward facing position. The latch means has a collar 7211 stopped inside the barrel 720, and a threaded bottom end 7212 extending out of the bottom hole of the barrel 720 and connected to the knob 723 by a screw joint. The spring 722 is mounted around the latch 721 within the barrel 720 and between the collar 7211 of the latch 721 and the bottom side of the barrel 720 to impart an upward pressure to the latch 721. When the knob 723 is pulled downward, the latch 721 is disconnected from the locating hole 711 or 712, permitting the top saddle 60 to be turned between the forward facing position and the backward facing position. When the knob 723 is released from the hand, the spring 722 immediately forces the latch 721 upward, causing it to insert into the locating hole 711 or 712, and to lock the top saddle 60 in the forward facing position or backward facing position.

What is claimed is:

1. A jogger exerciser comprising a first support frame having two parallel rod members with a top and a bottom and a first transverse extending bar joined to said bottom of said rod members, said two parallel rod members extending upward in a first direction from said first transverse extending bar to said top upper position; a second support frame including a pillar interposed between said two parallel rod members and pivoted to said two parallel rods, said pillar having a bottom secured to a second transverse extending bar; a handlebar assembly pivotally connected to said top of said first support frame and including a sleeve member, a handlebar stem mounted in said sleeve member, and a handle bar pivoted to said handlebar stem; a saddle assembly having an arm member pivoted between said two parallel rod members of said first support frame and connected to said handlebar assembly, a saddle mounted on said arm member, said arm having a front end pivoted to said two parallel rods and a rear end for supporting said saddle; and a link assembly for interconnecting said first support frame, said second support frame, and said sleeve member of said handlebar assembly;

said saddle assembly including a coupling sleeve passing over said arm member; said saddle having a bottom, a narrow portion and a wide portion; said bottom of said saddle secured to a locating plate, said saddle assembly further including latch means for securing said locating plate to said coupling sleeve, said locating plate having two locating holes and said latch means having a latch receivable in either of said locating so that said narrow portion or said wide portion of said saddle can face in said first direction, an arched foot support fastened to said rear end of said arm member of said saddle assembly adapted for resting of a user's feet;

said handlebar stem of said handlebar assembly having a rounded lower end inserted into a socket at a top end of said sleeve member of said handlebar assembly, two rows of longitudinally spaced locating holes at said rounded lower end at opposite sides thereof, so that said rounded lower end can be rotated and secured in position by use of said longitudinally spaced locating holes at two different positions relative to an axis of said handlebar stem, and said sleeve member of said handlebar assembly having a socket at a top end thereof which receives said rounded lower end of said handlebar stem, and a lock pin mounted in a radial hole thereof and inserted into one of said two rows of longitudinally spaced locating holes of said lower end of said handlebar stem to fix said handlebar stem in one of said two different positions.

2. The jogger exerciser of claim 1, wherein said handlebar assembly further comprises two hand grips fastened to two opposite ends of said handlebar.

3. The jogger exerciser of claim 1, wherein said latch means is comprised of a barrel, a latch, a spring, and a knob, said barrel fastened to said coupling socket of said saddle assembly at one side and having a top hole and a bottom hole, said latch mounted within said barrel having an upper portion thereof movable through said top hole of said barrel for inserting into one of said locating holes of said locating plate so that said either said narrow portion or said wide portion of said saddle faces in said first direction, said latch means further comprising a collar contained within said barrel, and a threaded bottom end extended out of said bottom hole of said barrel and fastened to said knob by a screw joint; said spring being mounted around said latch within said barrel and between said collar of said latch and a bottom side of said barrel to impart an upward pressure to said latch and to force said latch into engagement with one of said locating holes of said locating plate.

* * * * *